US005166912A

United States Patent [19]

Kanesaka

[11] Patent Number: 5,166,912

[45] Date of Patent: Nov. 24, 1992

[54] ANALOG ELECTRONIC TIMEPIECE

[75] Inventor: Toshiya Kanesaka, Tokyo, Japan

[73] Assignee: Seiko Instruments Inc., Japan

[21] Appl. No.: 637,490

[22] Filed: Jan. 4, 1991

[30] Foreign Application Priority Data

Jan. 16, 1990 [JP] Japan ..... 2-6544

[51] Int. Cl.[5] ..... G04F 8/00

[52] U.S. Cl. ..... 368/110; 368/113

[58] Field of Search ..... 368/76, 80, 110–113

[56] References Cited

U.S. PATENT DOCUMENTS

| | | | |
|---|---|---|---|
| Re. 30,852 | 1/1982 | Tamaru | 368/80 |
| 4,364,668 | 12/1982 | Gagnebin et al. | 368/80 |
| 4,537,514 | 8/1985 | Moriya | 368/107 |
| 4,623,261 | 11/1986 | Muto | 368/80 |
| 4,657,405 | 4/1987 | Nakazawa | 368/110 |

*Primary Examiner*—Vit W. Miska

*Attorney, Agent, or Firm*—Bruce L. Adams; Van C. Wilks

[57] ABSTRACT

An analog electric timepiece having a stop watch, and in the movement of hands when timepiece is used as the stop watch. The motion of the second hand, which moves to indicate one second at the time of the ordinary time display, is converted to the motion of a 1/10 second hand and moreover, the 1/10 second hand is allowed to move repeatedly only inside the range corresponding to the range from the zero-hour position to the 9-minute position of the dial of the timepiece. Furthermore, the minute hand and the hour hand for the ordinary time display are switched to operate as the second hand and to the minute hand, respectively, so as to accomplish an analog stop watch capable of measuring and displaying the 1/10 second.

1 Claim, 4 Drawing Sheets

ANALOG ELECTRONIC TIMEPIECE

BACKGROUND OF THE INVENTION

The present invention relates to an analog electronic timepiece having a stop watch which can measure a 1/10 of a second increment.

Conventional analog electronic timepieces having a stop watch which can measure a 1/10 of a second increment, for example, are equipped with a 1/10 second hand separate from the hands for the ordinary time display but use the ordinary second and minute hands as such for the ordinary display.

Also known are the timepieces having the structure wherein the second hand and the 1/10 second hand effect the stop watch operation under the condition where the hour hand and the minute hand indicate the time during the execution of the stop watch function, and the second hand indicates the second while the 1/10 second hand indicates the minute and the 1/10 second when the operation mode is switched.

However, in the conventional stop watch equipped with the 1/10 second hand, a small additional second hand must be disposed for constituting the 1/10 second hand and a motor and a mechanism for driving the 1/10 second hand hand must also be disposed separately. Accordingly, after problems occur because the structure of the timepiece gets complicated and the number of components increases.

SUMMARY OF THE INVENTION

It is an object of the present invention to provide an analog stop watch which can count and measure 1/10 second increments under the ordinary center three-hand structure state without additionally disposing a small second hand.

In the present invention, the hour, minute and second hands of the ordinary three-hand timepiece are allowed to operate as the minute, second and 1/10 second hands, respectively, by merely switching the operation mode through mode switching means, the 1/10 second hand is permitted to move repeatedly only within the range corresponding to the range of the zero-hour position to the 9-minute position of the dial of the timepiece and a 1/10 second stop watch is constituted without additionally disposing a small second hand.

In order to operate the stop watch, 1/10 second counting means, stop watch second counting means and stop watch minute counting means are operated through mode switching means, and a hand for indicating the second during the ordinary time display is utilized as the hand for displaying the 1/10 second and is permitted to move repeatedly only within the range corresponding to the range from the zero-hour position to the 9-minute position of the dial of the timepiece. Accordingly, the 1/10 second stop watch can be constituted without additionally disposing a small second hand.

DETAILED DESCRIPTION OF THE PREFERRED EMBODIMENTS

Hereinafter, an embodiment of the analog timepiece equipped with a stop watch of the present invention will be explained with reference to the drawings.

Figure 1:
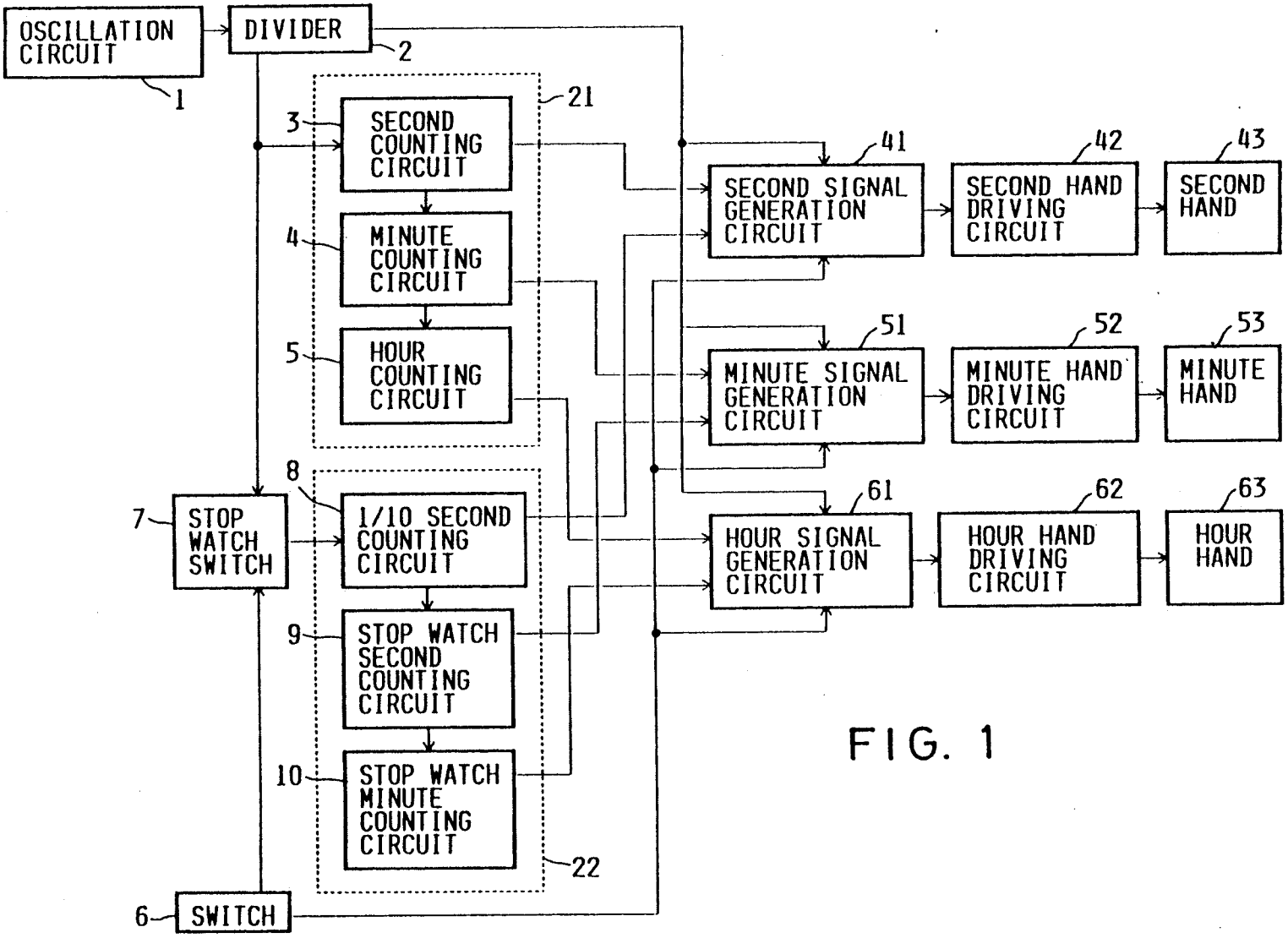
FIG. 1 is a block diagram of an electronic timepiece in accordance with the present invention.

FIG. 1 is a functional block diagram of the analog timepiece equipped with a stop watch in accordance with the present invention. In the drawing, an oscillation circuit 1 uses an oscillator such as a quartz and functions as a time reference. A frequently divider 2 converts the output of the oscillation circuit 1 to a low frequency. A second counting circuit 3 counts the time of the timepiece in seconds on the basis of the output of the frequency divider 2. A minute counting circuit 4 counts the time of the timepiece on the basis of the output of the second counting circuit 3. The hour counting circuit 5 counts the time of the timepiece in hours on the basis of the output of the minute counting circuit 4. A switch 6 operates the displays of the timepiece and of the stop watch. The stop watch switch 7 outputs the output of the frequency divider 2 to the 1/10 second counting circuit 8 by the output of the switch 6 and controls the start/stop conditions of the stop watch. The 1/10 second counting circuit 8 counts the 1/10 second increments of the stop watch by the output of the stop watch switch 7. The stop watch second counting circuit 9 counts the second increments of the stop watch by receiving the output, which occurs once per second from the 1/10 second counting circuit 8. The stop watch minute counting circuit 10 counts the minute increment of the stop watch by receiving the output which occurs once every 60 seconds of the stop watch second counting circuit 9. The time counting circuit 21 includes the second counting circuit 3, the minute counting circuit 4, an the hour counting circuit 5. The stop watch counting circuit 22 includes the 1/10 second counting circuit 8, the stop watch second counting circuit 9, and the stop watch minute counting circuit 10.

A second signal generation circuit 41 selects and outputs the signal of either one of the second countings circuit 3 or 1/10 second counting circuit 8 as controlled by the output of the switch 6 and the second signal driving circuit outputs the driving signal for the second display 43 of the timpeice or the 1/10 second display of the stop watch. A minute signal generation circuit 51 selects the signal of either one of the minute counting circuit 4 or the stop watch second counting circuit 9 as controlled by the output of the switch 6 and the minute signal generation circuit 51 outputs the driving signal for the minute display of the timepiece or the second display of the stop watch. An hour signal generation circuit 61 selects the signal of either one of the hour counting circuit 5 or the stop watch minute counting circuit 10 as controlled by the output of the switch 6 and outputs the driving signal for the hour display of the timepiece or the minute display of the stop watch. A second hand driving circuit 42 drives a second hand 43 by outputting the a signal from the second hand driving circuit 42. A minute hand driving circuit 52 drives the minute hand outputting the output of the minute hand driving circuit 52. An hour hand driving circuit 62 drives an hour hand 63 by outputting a signal from the hour hand driving circuit 62. A second hand 43 displays both the time of the timepiece in seconds and the 1/10 second count of the stop watch by receiving the signal outputted from the second hand driving circuit 42 described above. A minute hand 53 displays the times of the timepiece in minutes and the second count of the stop watch by receiving the signal minute hand driving circuit 52. An hour hand 63 outputted from the displays the time of the time piece in hours the minute count of the stop watch by receiving the signal outputted from the hour hand driving circuit 62.

Figure 2:
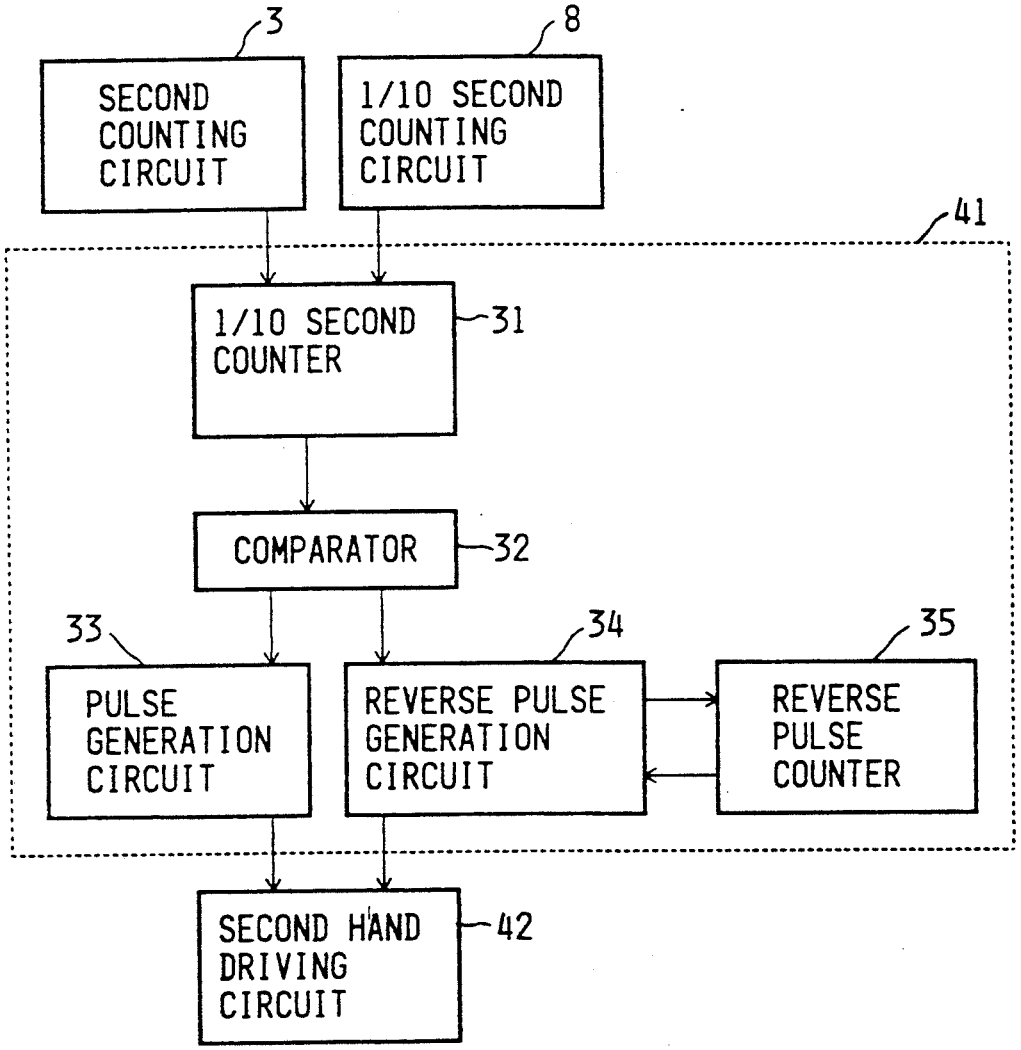
FIG. 2 is a block diagram of the second signal generation circuit.

FIG. 2 is a block diagram of the second signal generation circuit 41. The 1/10 second counter 31 receives the output signal of the second counting circuit 3 and the 1/10 second counting circuit 8, and counts the received signal. A comparator 32 compares the counted value of the 1/10 second counter with the value 10. A pulse generation circuit 33 outputs the pulse for rotating the display means (not shown in FIG. 2) by means of the second hand driving circuit 42, when the counted value is less than 10. A reverse pulse generation circuit 34 outputs the pulse for driving the display means 43 reversely by means the second hand driving circuit 42, when the counted value if 10. A reverse pulse counter 35 counts the number of the reverse pulses outputted by the reverse pulse generation circuit 34.

Figure 3:
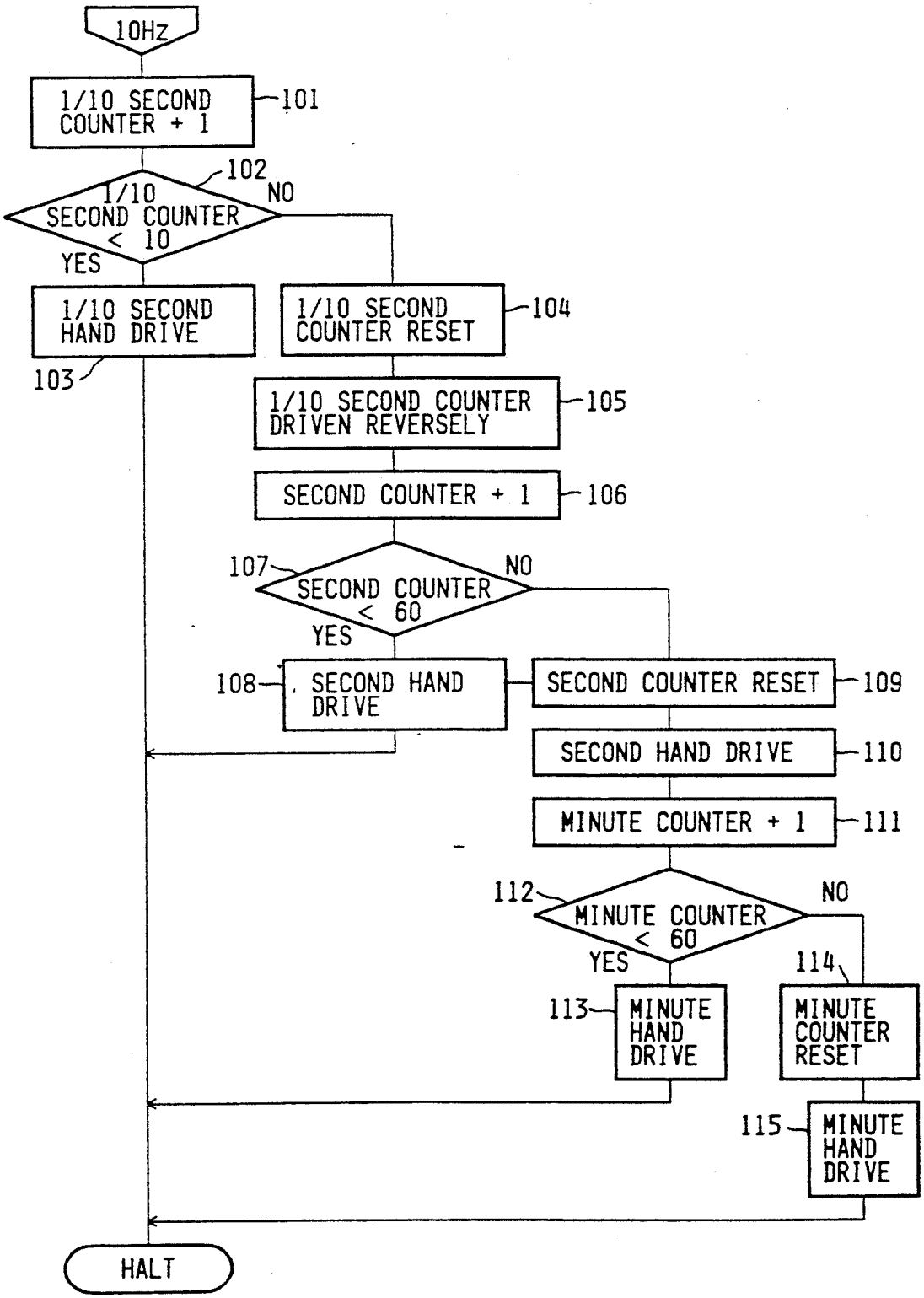
FIG. 3 is a flowchart at the time of counting under the stop watch state.

Next, the operation of the stop watch will be explained with reference to the flowchart of FIG. 3. The operation of the stop watch is effected by counting the period of the 10 Hz signal. The 10 Hz signal is outputted by the frequency divider 2 and is counted by the 1/10 second counting circuit 8 and the 1/10 second counter 31 is incremented by one step by the interrupt of the 10 Hz signal (step 101). Next, if the count value is less than 10 when the 1/10 second counter 31 is compared with 10 (step 102), the second hand 43 is driven forward by one step whenever the 1/10 second counter 31 counts and 1/10 second is displayed (step 103). When the count value of the 1/10 second counter 31 counts 10, the 1/10 second counter 31 is reset (step 104), the second hand 43 is driven reversely and is reset to the value 0 (step 105) and the stepwatch second counter 9 is incremented by one step (step 106). Next, is the count value is less than 60 when the second the stop watch second counter 9 is compared with 60 (step 107), the minute hand 53 is driven forwardly by one step to display the stop watch second counter counts (step 108). The stopwatch second counter 9 is reset when the count value of the stopwatch second counter 9 exceeds 60 (step 109) and the minute counter 10 incremented by one step (step 111). Next, if the count value of the stopwatch minute counter 10 is less than 60 when the minute counter is compared with 60 (step 112), the hour hand 63 is driven by one step to display the minute counted whenever the stop watch minute counter 10 counts (step 113). When the count value of the stopwatch minute counter exceeds 60, the stopwatch minute counter 10 is reset (step 114). The processing described above is made whenever the 10 Hz interrupt is made.

Figure 4:
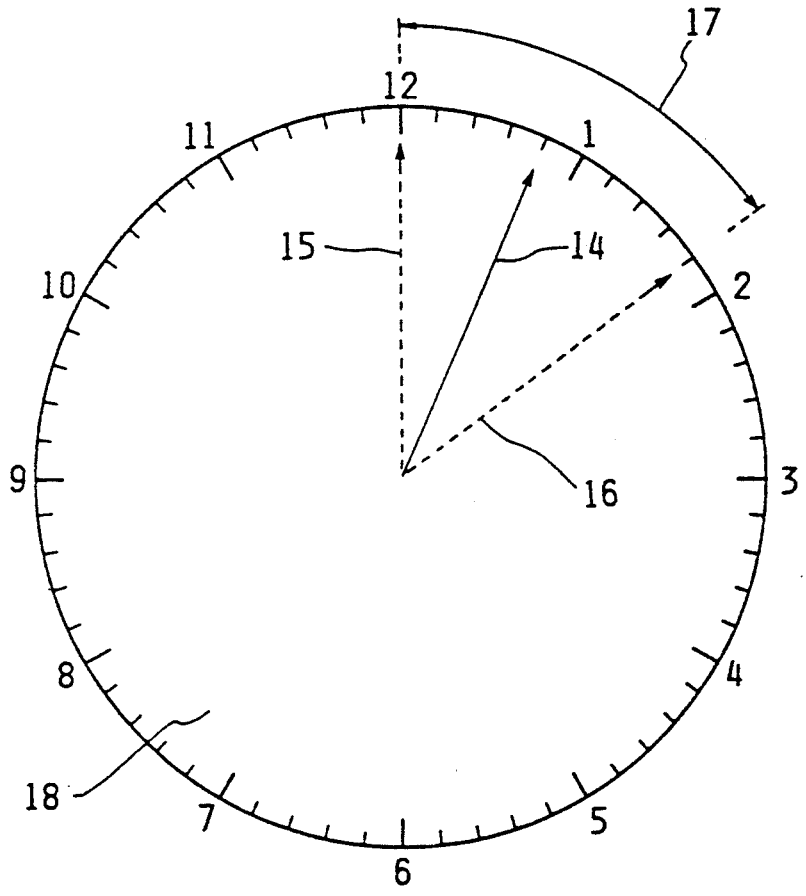
FIG. 4 is a plan view of a display portion and shows the display state of the present invention.

Next, an example of the display will be explained with reference to FIG. 4. In the drawing, a second hand 14 displays the second at the time of time display and functions also as the 1/10 second hand at the time of the stop watch operation. The start position 15 is the position of 1/10 second display of the stop watch when the stopwatch mode is selected. The maximum indication range of movement 17 is the range of the second hand 14 when the 1/10 second display of the stop watch is selected. In other words, the operation range of the second hand 14 under the stop watch state is from the position of 12 o'clock at the zero position 15 to the position of 9-minute position 16 indicated by arrow within the operation range 17. The second hand 14 causes reciprocating motion within this range in order to display the 1/10 second. The operation range 17 is the range in which the second hand 14 operates for the 1/10 second display of the stop watch. A dial 18 displays the time and the stop watch display, as well.

Due to the construction and the operations described above, the second display of the timepiece and the 1/10 second display of the stop watch can be accomplished by the same indication hand and the same dial.

As described above, in accordance with the present invention, the second display, the minute display and the hour display used ordinarily for the time display are switched to the 1/10 second display, the second display and the minute display by the mode switch and moreover, the second hand used ordinarily for the second display in the time display is used for the 1/10 second display in the hand operation is repeated only within the range corresponding to the zero-hour position to the 9-minute position to the dial. Accordingly, the present invention can provide a smart stop watch without additionally disposing a small second hand.

What is claimed is:

1. An analog electric timepiece comprising:

an oscillator for outputting a reference signal;

frequency divider means receptive of the reference signal for dividing the reference signal and producing an output signal;

mode changing means for changing between a stop watch mode and a watch mode;

time information counting means receptive of the output signal from said frequency divider means for counting time information, the time information counting means including a second counting circuit for counting second information, a minute counting circuit for counting minute information and an hour counting circuit for counting hour information;

stop watch information counting means receptive of the output signal from said frequency divider means for counting stop watch information, the stop watch information counting means including a 1/10 second counting circuit for counting 1/10 second information and a 1/10 minute counting circuit for counting 1/10 minute information;

driving means receptive of the counted time information output from said time information counting means and the counted stop watch information output from said stop watch information counting means for producing and outputting a driving signal;

display means driven by the driving signal for displaying the time information and the stop watch information;

1/10 second counting means for counting the output of said 1/10 second counting circuit and resetting when the counted value becomes 10;

comparing means for comparing the value counted by said 1/10 second counting means to 10; and a second signal generation circuit for outputting a driving signal for driving said display means one increment forward when the counted value of the 1/10 second counting means is less than 10 and for outputting a driving signal for driving said display means nine increments backward when the counted value is 10.

* * * * *